US005934527A

United States Patent [19]

Von Neumann

[11] Patent Number: 5,934,527

[45] Date of Patent: Aug. 10, 1999

[54] MODULAR BACKPACK

[75] Inventor: Monica Von Neumann, 1590 Stone Canyon Rd., Los Angeles, Calif. 90077

[73] Assignee: Monica Von Neumann, Los Angeles, Calif.

[21] Appl. No.: 09/039,659

[22] Filed: Mar. 16, 1998

[51] Int. Cl.[6] ..... A45F 4/02

[52] U.S. Cl. ..... 224/153; 224/582; 224/583

[58] Field of Search ..... 224/153, 580, 224/582, 583, 600, 627, 257, 259; 150/106, 107, 111, 113; 190/108, 110, 117

[56] References Cited

U.S. PATENT DOCUMENTS

| | | | |
|---|---|---|---|
| 3,061,057 | 10/1962 | Miller . | |
| 3,122,225 | 2/1964 | Ward . | |
| 3,443,671 | 5/1969 | Dyke . | |
| 3,831,651 | 8/1974 | Leahy | 150/111 |
| 4,018,369 | 4/1977 | Jaeger . | |
| 4,081,061 | 3/1978 | Tucker . | |
| 4,236,657 | 12/1980 | Brunton . | |
| 4,491,258 | 1/1985 | Jones . | |
| 4,609,084 | 9/1986 | Thomas . | |
| 4,756,394 | 7/1988 | Cohen | 190/18 |
| 4,883,207 | 11/1989 | McArthur . | |
| 4,884,731 | 12/1989 | Sibley . | |
| 5,186,290 | 2/1993 | Takayama . | |
| 5,197,525 | 3/1993 | Cantor | 150/102 |
| 5,395,023 | 3/1995 | Naymark . | |
| 5,402,869 | 4/1995 | Satzman . | |
| 5,509,515 | 4/1996 | Guo . | |
| 5,544,792 | 8/1996 | Arnwine | 224/153 |
| 5,615,812 | 4/1997 | Martin . | |
| 5,628,443 | 5/1997 | Deutsch . | |

*Primary Examiner*—Allan N. Shoap
*Assistant Examiner*—Maerena W. Brevard
*Attorney, Agent, or Firm*—Peter J. Phillips

[57] ABSTRACT

A modular backpack has four bags or units usable connected together by zippers or snaps or the like. The bags may also be used separately or in various subcombinations. The bags comprise a main bag with shoulder straps useable as a backpack, a middle bag connectable to the bottom of the main bag, and a lower bag connectable to the bottom of the middle bag or directly to the bottom of the main bag. The middle bag may be used alone or together with a lower bag as a waist bag. A purse is removably attached to the main bag.

8 Claims, 8 Drawing Sheets

MODULAR BACKPACK

BACKGROUND OF THE INVENTION

The present invention relates to a modular backpack separable into units and useable with the units connectable in various combinations.

There are various backpack designs which exist for carrying items such as clothing, books and other personal items. Such backpacks have become particularly popular for use by children and adolescents for carrying items to and from school and for recreational use.

There are also various waist bag designs for carrying items in a waist bag which have also become popular for use by children and adolescents, in particular.

Various well-known clothing and accessory designers have marketed and sold knapsacks and other bags in a product line, each usually sold separately and each carrying the trademark and/or trade dress of the designer.

A consumer, faced with the knapsack and bag options available, has typically been forced to purchase and use separately many different bags and bag styles, each one having a particular design and specific intended use. The result has been significant added cost to the consumer, especially for designer lines sold at premium prices due to the designers popularity, but has also resulted in the accumulation of a large number of bags requiring extra storage space, as well as the need to transfer items among different bags to carry a bag having a particular size which suits the need at a given time.

It would be desirable to provide a multi-use bag having a backpack separable into units and useable with the units connectable in various combinations.

SUMMARY OF THE INVENTION

It is an object of the present invention to provide a multi-use bag having a backpack separable into units and connectable in various subcombinations, usable alone or together.

It is an other object of the present invention to provide a backpack comprising a main back, usable as a backpack, connectable to a middle pack, which in turn is connectable to a lower pack, at least one of the middle or lower pack usable independently as a waist pack.

It is an other object of the present invention to provide a backpack having a number of units, each having at least one storage compartment therein, wherein at least one of the units has an access opening hidden from view when the units are connected together for security or other purposes.

In accordance with the present invention, a backpack is provided having a main pack usable as a back pack, a middle pack or bag connectable to the bottom of the main pack, a lower pack or bag connectable to the middle pack or bag, and a purse connectable to at least one the other packs or bags.

In accordance with the present invention, a modular backpack is provided, comprising a main bag having a top, a bottom, a front, a back and two sides. The main bag has two shoulder straps connected to the back of said main bag, and includes an opening in the top of said main bag for inserting and removing articles, and a flap cover attached to the upper back and removably attached to the upper front. The main bag further includes a first zipper portion around the bottom of said main bag, and snaps on the back to hold a purse. A middle bag is provided having a top, a bottom, a front, a back and two sides. The middle bag has a second zipper portion around the top thereof adapted to be connected to the first zipper portion of the main bag so as to releasably attach said middle and main bags together. The middle bag includes a third zipper portion around the bottom thereof. The middle bag includes a first waist strap portion attached to one side of the middle bag, and a second waist strap portion attached to the other side of the middle bag. The first and second strap portions having at their non-attached ends releasable engagement devices to releasably engage their respective non-attached ends after the waist straps encircle a user. The middle bag includes a zippered entry opening in one of the top and bottom sides.

The backpack includes a lower bag having a top, a bottom, a front, a back and two sides, and a fourth zipper portion around the top thereof adapted to be connected to the third zipper portion so as to releaseably attach the lower and middle backpack bags together. The first zipper portion is also being releaseably attachable to said fourth zipper portion to releaseably attach said lower and main backpack bags together. The lower bag includes a zippered entry opening and loops attached around the lower bag for releasably receiving the end of a strap having a releasable hook. The backpack includes a purse bag having a handle, an opening in said purse bag and a flap closure for covering said opening, with the flap having snaps for holding the flap closure in a closed position. The purse bag includes second snap portions for releasably engaging with snaps on front of the main bag.

The backpack may be used as one combination bag with the main bag, middle bag and lower bag connected together, with or without the purse bag. The main bag and middle bag may be used with the lower bag with or without the purse bag, wherein the main bag and lower bag may be used together with or without the purse bag, wherein the middle and lower bags may be used together without the main bag, and wherein each bag may be used separately.

Other objects, advantages and features will become more readily apparent from the following detailed description of a preferred embodiment, accompanying claims and attached drawing figures.

DETAILED DESCRIPTION OF THE PREFERRED EMBODIMENTS

The present invention will be described in the context of two preferred embodiments. One of the preferred embodiments will be referred to as a women's version, and the other as a men's version. It should be understood that either version may be used by a person of either sex or any age, and they are not intended to be limited to their use or application. Further, the preferred embodiments disclose particular ways of implementing the invention in an article, but the invention is not intended, nor should the invention be interpreted as being limited to either of these two preferred embodiments. The scope of the invention will be defined by the appended claims.

Figure 1:
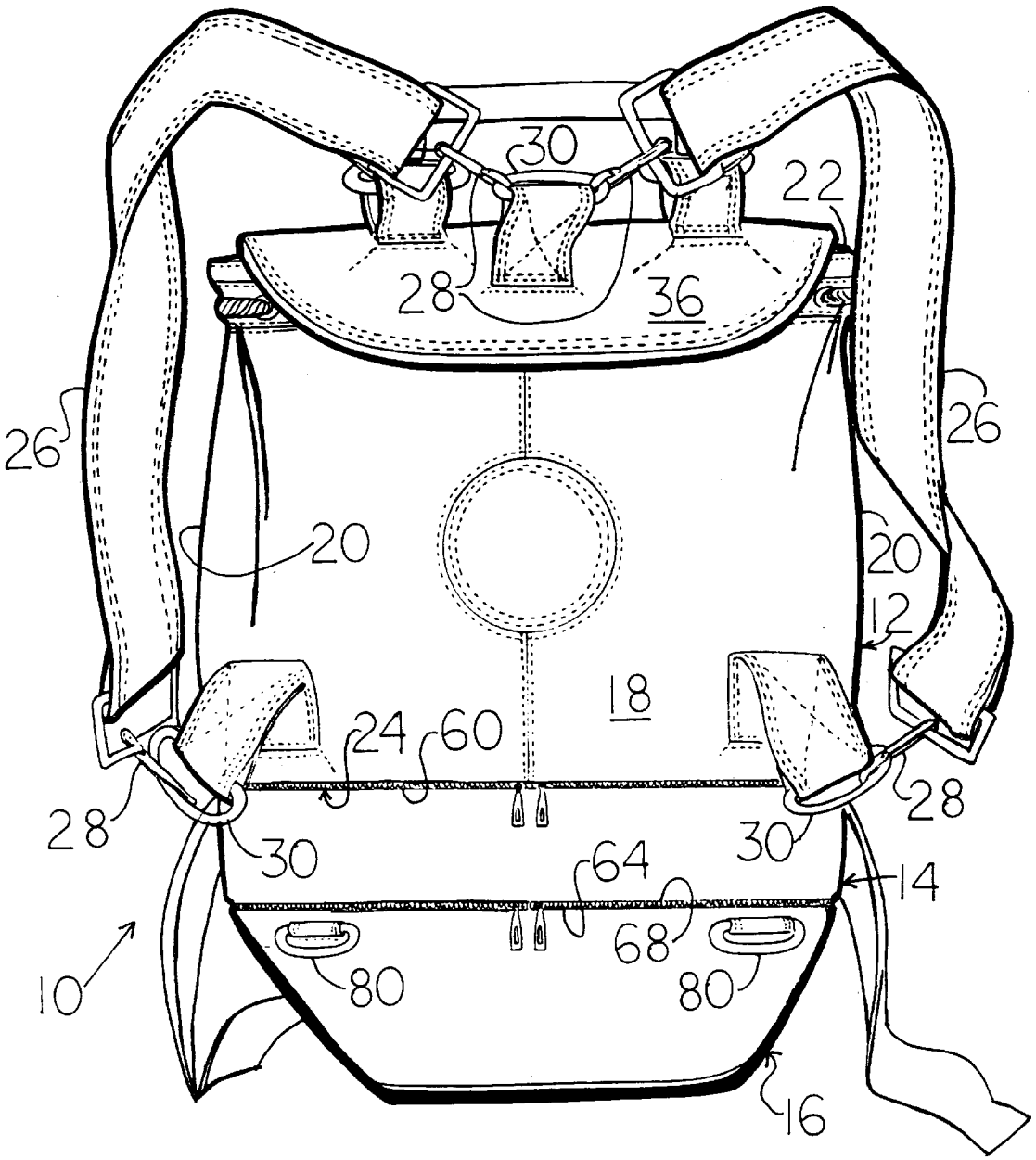
FIG. 1 is a back view of a women's combination backpack according to the invention.
Figure 2:
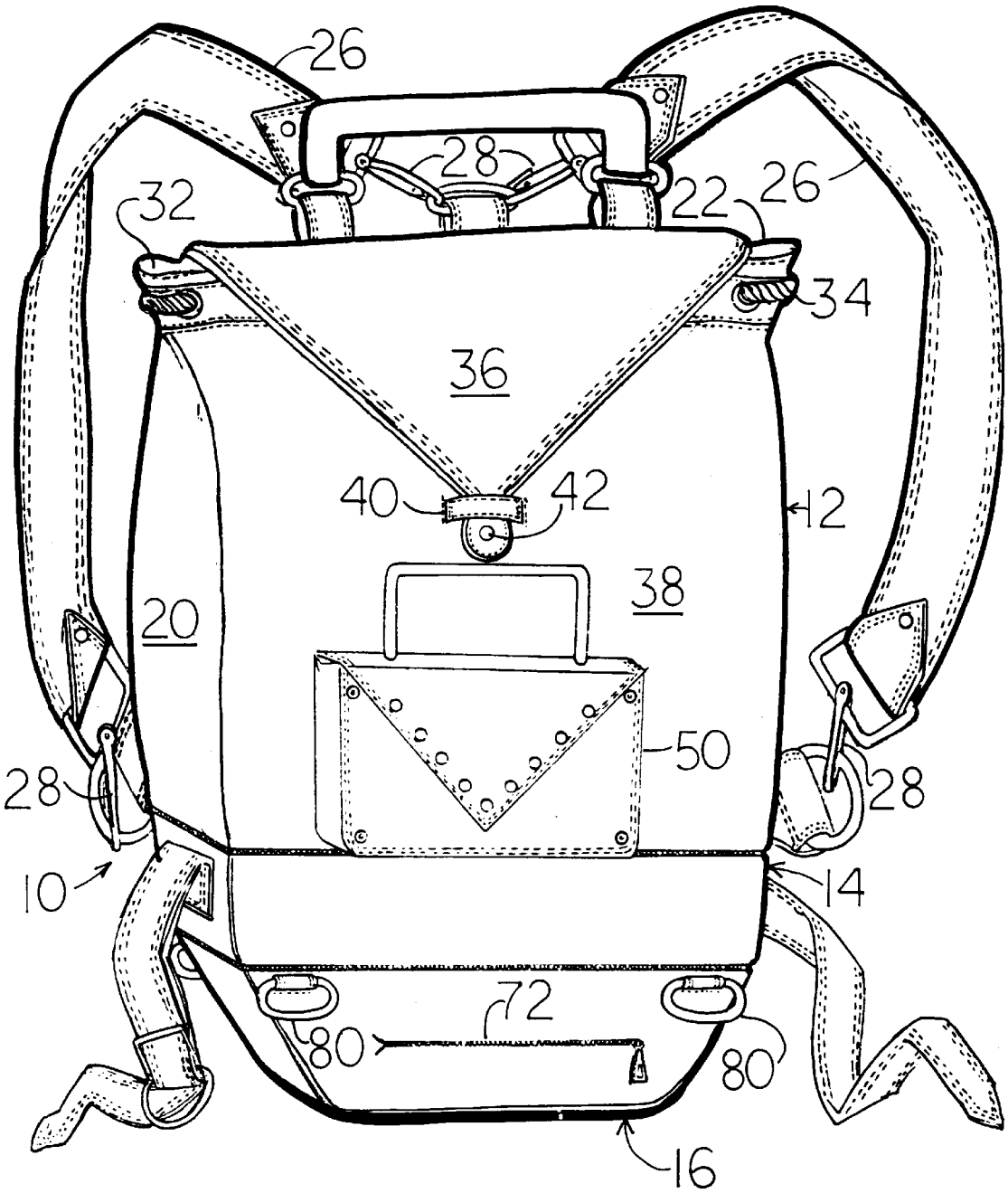
FIG. 2 is a front view of a women's combination backpack according to the invention.

Referring to FIGS. 1 and 2, the backpack 10 comprises a main bag 12, middle bag 14 and a lower bag 16. The main bag has a back 18, two sides 20, a top 22, and a bottom 24. The main bag has shoulder straps 26 connectable by releasable hooks 28 onto loops 30. One loop is attached to the top of the main bag at the top of the back 18, and two other loops are attached to the back of the main bag at the bottom of the back, near the sides 20. The loops are attached with straps. The top of the main bag 12 has an opening 32 to gain access to a storage compartment, and the opening has a drawstring 34 arranged around the perimeter of the bag top to close the bag. A top flap 36 folds over the main bag top to close the main bag opening 32, even if the drawstring is relatively loose, and can serve to protect the main bag contents from inclement weather. The flap is connectable to the front 38 of the main bag through a loop 40 with a releasable fastener 42.

Figure 3B:
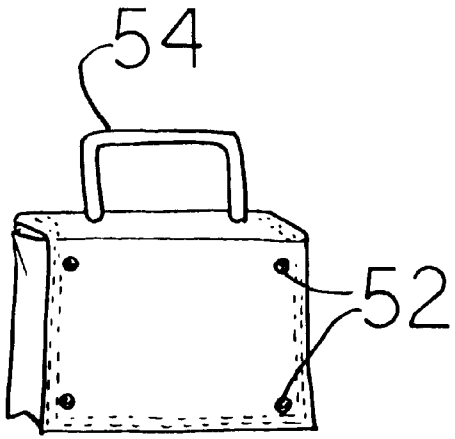
FIG. 3B is a back view of the purse bag of FIG. 3A.
Figure 3A:
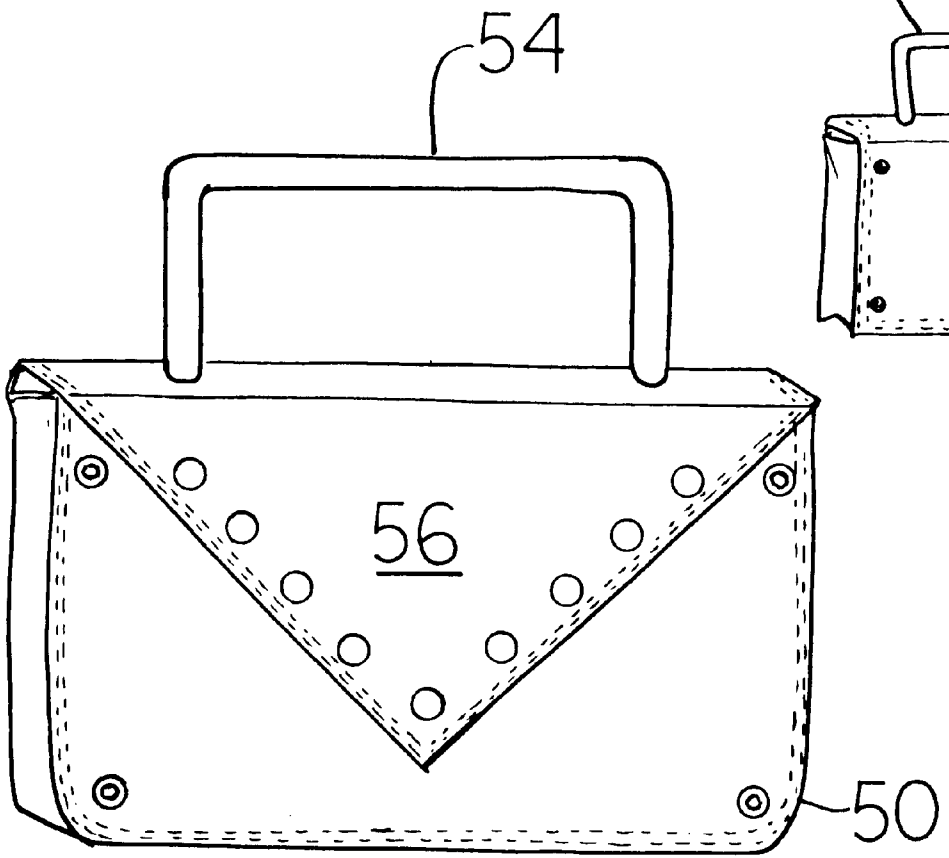
FIG. 3A is a front view of a the women's purse bag separated from the combination backpack.

A removable purse 50 is attached to the front 38 of the main bag with snaps 52 (see FIG. 3B) which releaseably engages mating snaps on the front of the main bag. The purse has a handle 54 and a flap top closure 56 with one or more releasable closures of snaps or Velcro-type fasteners.

As shown in FIG. 1, the bottom of 24 of the main bag 12 has a zipper portion 60 around its periphery which is adapted to mate with a corresponding zipper portion 62 around the top edge of the middle bag.

The middle bag 14 has a zipper portion 64 around its bottom periphery which is adapted to mate with a corresponding zipper portion 68 around the top edge of the lower bag 16. The middle bag 14 may be removed from the main bag 12, so that the middle bag 14 and lower bag 16 can be used together, separate from the main bag 12, or the lower bag 16 can be connected by zipper portions 60 and 68 to the main bag, using the main and lower bags 12 and 16 without the middle bag 14.

Figure 5:
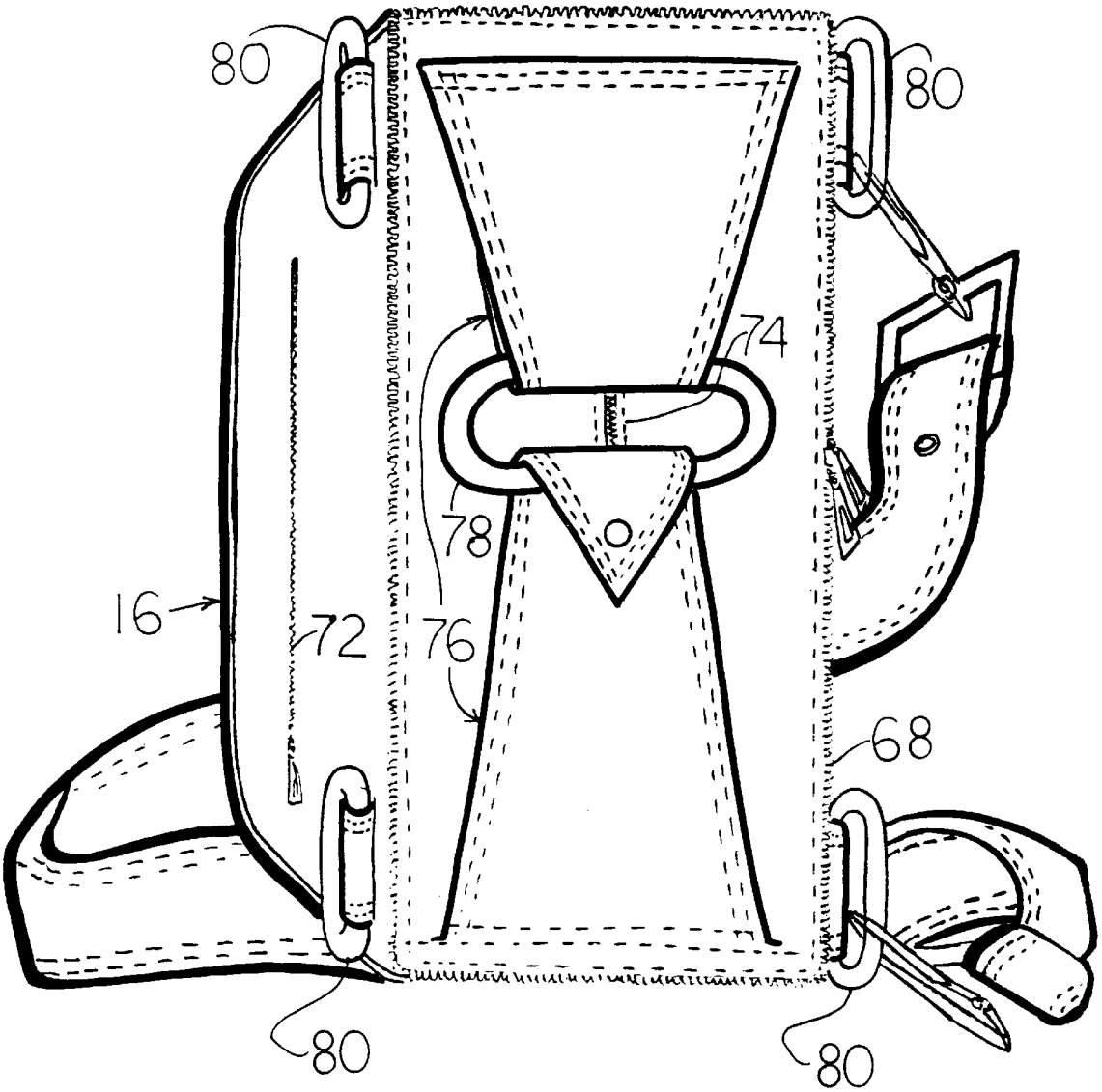
FIG. 5 is a back view of the lower bag separated from the combination backpack, for both the women's and men's versions.
Figure 6:
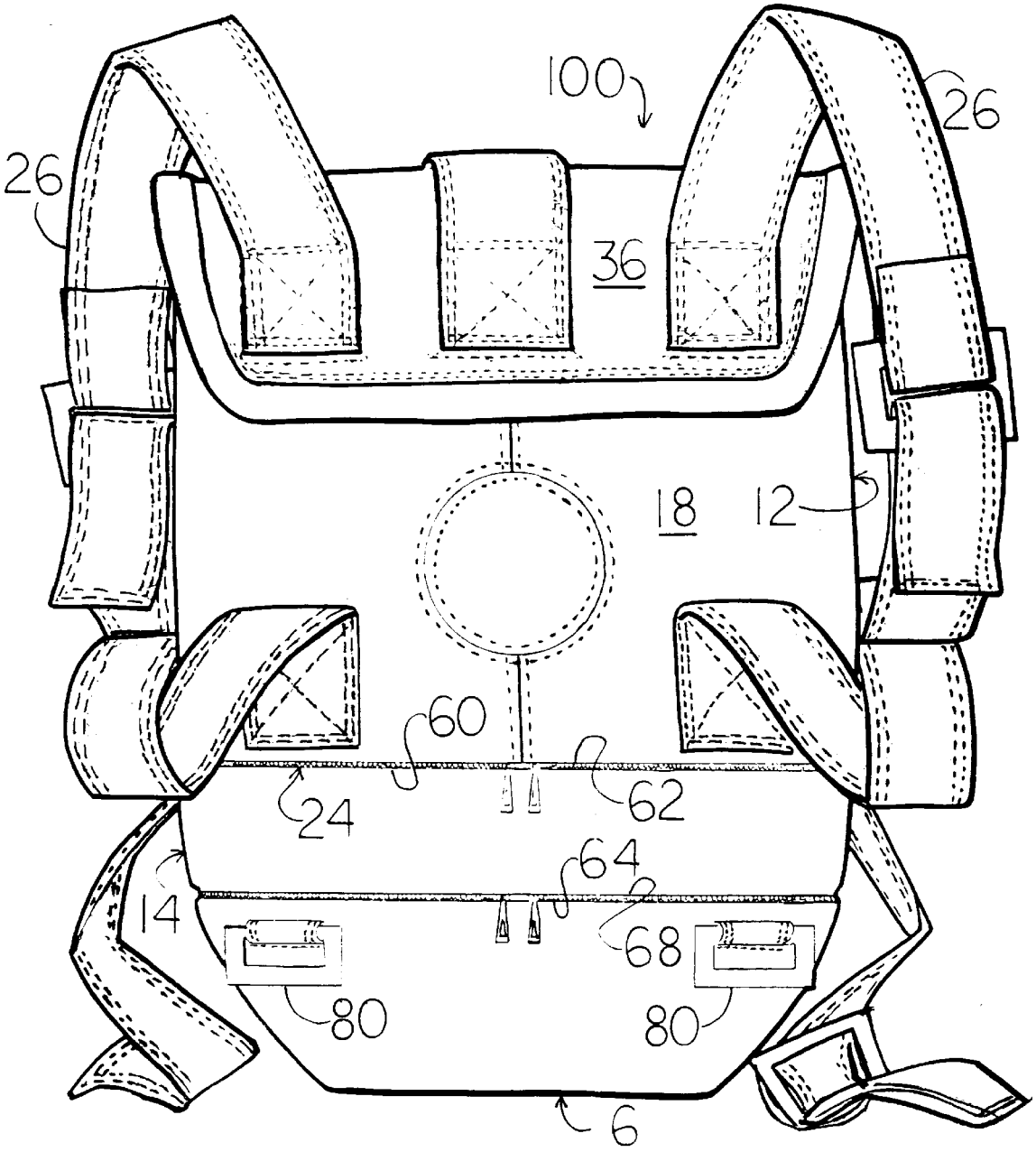
FIG. 6 is a back view of a men's combination backpack according to the invention.
Figure 7:
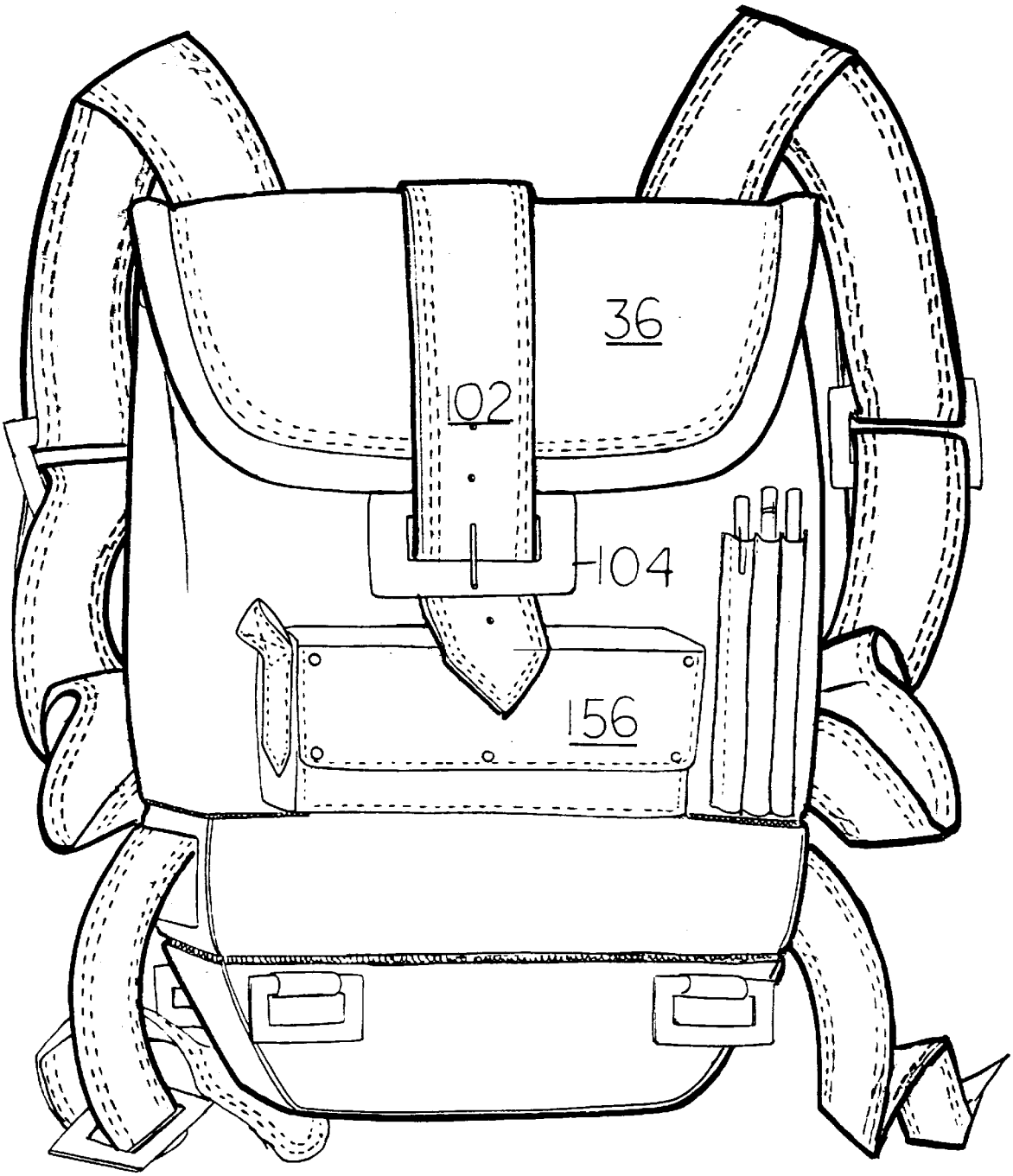
FIG. 7 is a front view of a men's combination backpack according to the invention.
Figure 8B:
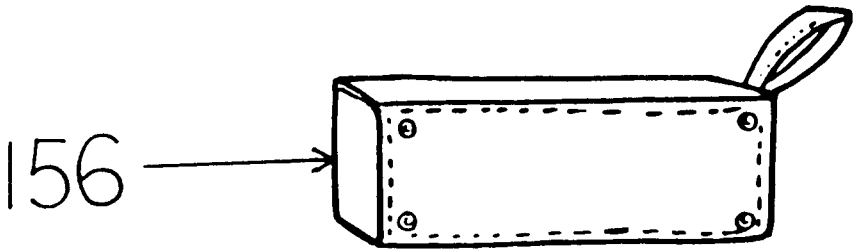
FIG. 8B is a back view of the men's purse bag separated from the combination backpack.
Figure 8A:
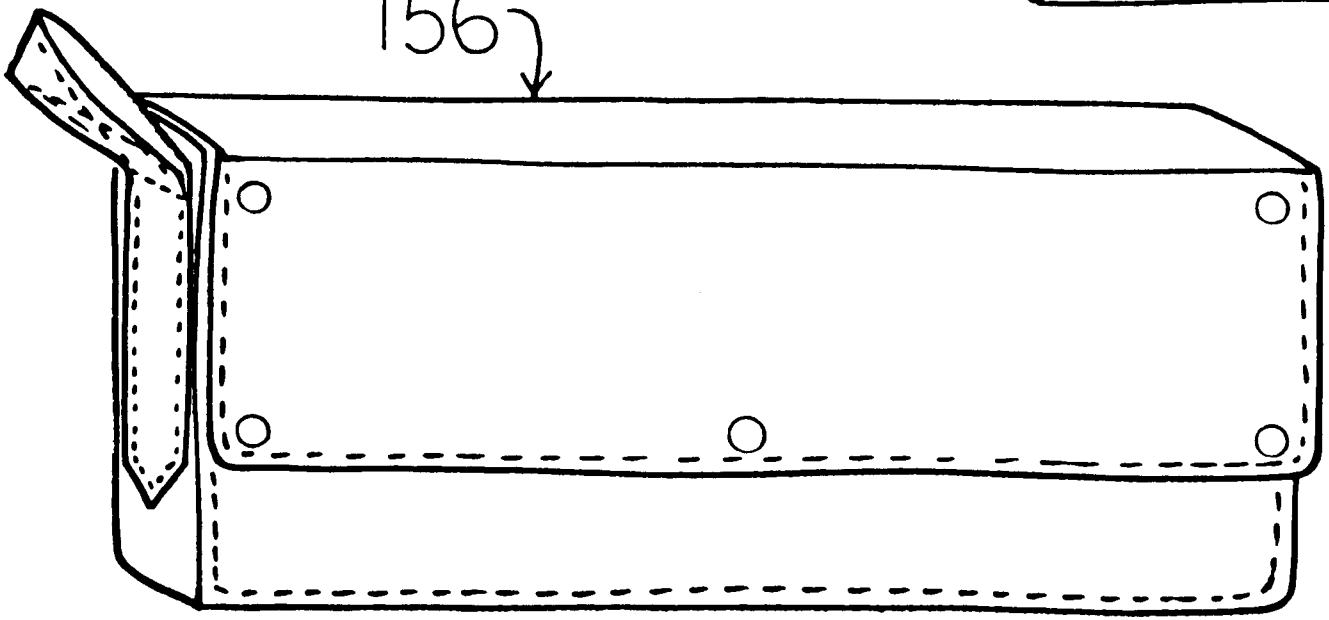
FIG. 8A is a front view of the men's purse bag separated from the combination backpack.

As seen in FIG. 2 and FIG. 5, the lower bag 16 has an inner storage compartment accessible through zippered closure 72, which is visible. The same or a different inner storage compartment is accessible through zippered closure 74 which is not visible when the lower bag is connected to either the middle bag 14 or main bag 12. A strap 76 and loop 78 are arranged to mostly conceal the zipper closure 74 from view. Around the upper edge of the lower bag 16 are loops 80 which can be used to connect to a strap, such as shoulder strap 26, with releasable hooks. If the two shoulder straps are connected to the four hoops 80, the lower bag can itself be used as a knapsack.

Figure 4:
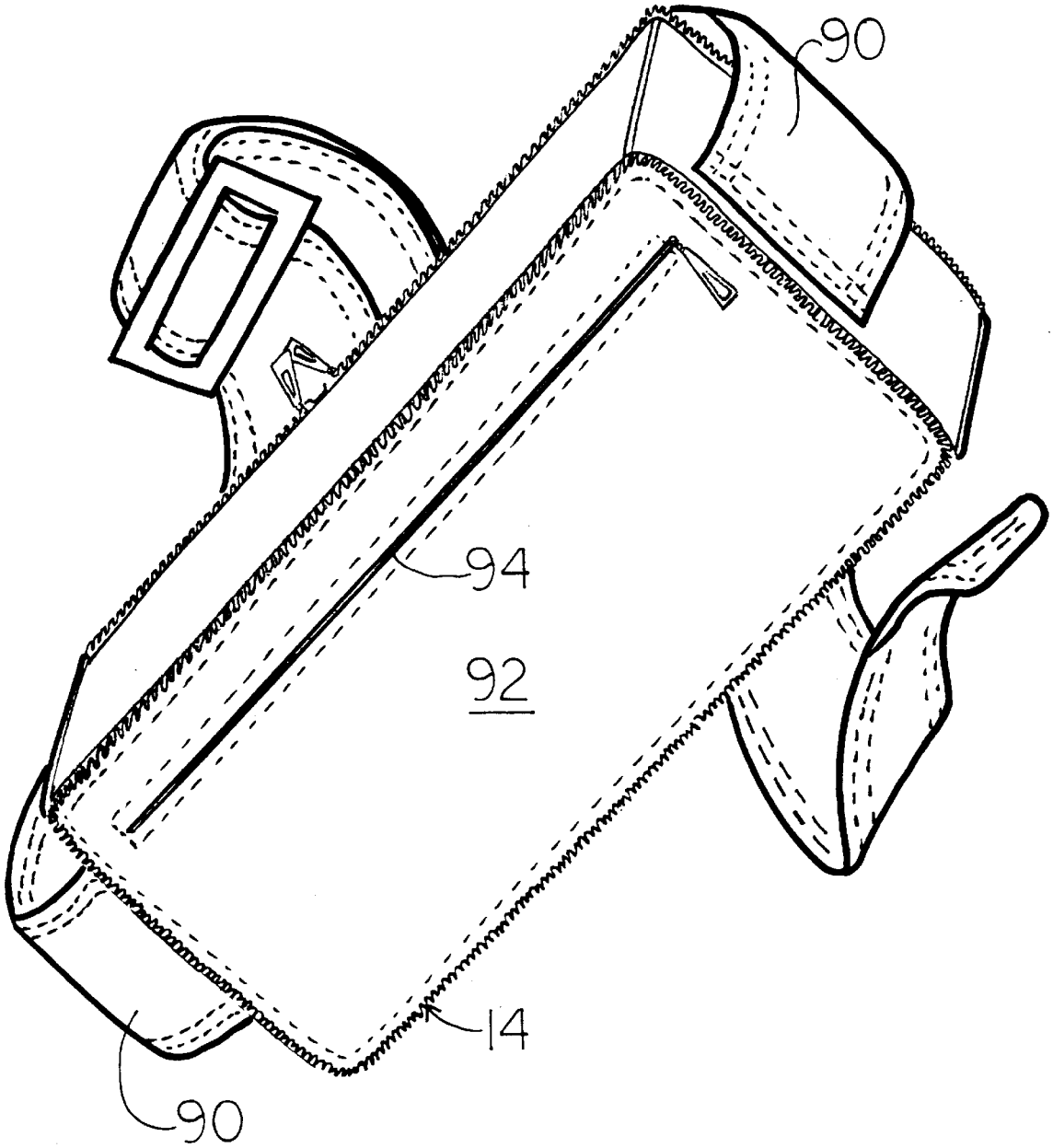
FIG. 4 is a perspective view of the middle bag separated from the combination back pack for both the women's and men's versions.

As shown in FIG. 4, the middle bag 14 has two strap portions 90 connected to either side which strap portions can be used to encircle the waist of a user s that the bag can be used as a waist bag. The respective non-attached ends are connectable such as by a buckle and holes, or other connectable arrangement. The face 92 of the middle bag has a zippered closure 94 for enabling access and closure to an inner compartment, which zippered closure will be hidden when the face is connected to the lower bag 16.

FIGS. 6,7,8A and 8B show the corresponding portions of the men's backpack which differ from the women's backpack. The men's backpack 100 has shoulder straps 26 sewn to the main pack, has a belt 102 and buckle 104 arrangement to close the top flap 36, has a writing instrument holder 106, and has a purse 156 which has a different handle 154 than handle of the women's purse.

While two embodiments have been shown and described, numerous variations and modifications will occur to those skilled in the art. The invention is not limited in scope to the preferred embodiments, and is defined by way of the following claims.

I claim:

1. A modular backpack, comprising:

a main bag having a top, a bottom, a front, a back and two sides, and further comprising two shoulder straps connected to the back of said main bag, and further comprising an opening in the top of said main bag for inserting and removing articles, and a flap cover attached to the upper back and removably attached to the upper front, and further comprising a first zipper portion around the bottom of said main bag, said main bag further indicating first snaps on the back;

a middle bag having a top, a bottom, a front, a back and two sides, and further comprising a second zipper portion around the top thereof adapted to be connected to the first zipper portion so as to releasably attach said middle and main bags together and further comprising a third zipper portion around the bottom thereof, and further comprising a first waist strap portion attached to one side of the middle bag, and a second waist strap portion attached to the other side of the middle bag, said first and second strap portions having at their non-attached ends releasable engagement devices to releasably engage their respective non-attached ends after the waist straps encircle a user;

and further comprising a zippered entry opening in one of the top and bottom sides of the middle bag;

a lower bag having a top, a bottom, a front, a back and two sides, and further comprising a fourth zipper portion around the top thereof adapted to be connected to the third zipper portion so as to releaseably attach said lower and middle backpack bags together, said first zipper portion also being releaseably attachable to said fourth zipper portion to releaseably attach said lower and main backpack bags together; said lower bag further comprising a zippered entry opening and loops attached around the lower bag for releasably receiving the end of a strap having a releasable hook; and a purse bag having a handle, an opening in said purse bag and a flap closure for covering said opening, said flap having snaps for holding the flap closure in a closed position, said purse bag further comprising second snaps portions for releasably engaging with said first snap portions on front of the main bag;

whereby the backpack may be used as one combination bag with the main bag, middle bag and lower bag connected together, with or without the purse bag, wherein the main bag and middle bag may be used together with or without the purse bag, wherein the main bag and lower bag may be used together with or without the purse bag, wherein the middle and lower bags may be used together without the main bag, and wherein each bag may be used separately.

2. The backpack according to claim 1, wherein the main bag has a handle attached to the flap cover.

3. The backpack according to claim 1, wherein the opening in the top of the main bag has a drawstring closure around the periphery of the opening.

4. The backpack according to claim 1, wherein the main bag flap cover is removable attached to the upper front of the bag by a strap and buckle.

5. The backpack according to claim 1, wherein the main bag flap cover is removably attached to the upper front of the bag by a snap closure.

6. The backpack according to claim 1, wherein the lower bag has a zippered opening in the top thereof.

7. The backpack according to claim 1, wherein the two shoulder straps are connected to the main bag by means of a first upper loop attached to the upper back of the main bag and two bottom loops attached to the lower back of the main bag near the two main bag sides, and wherein each shoulder strap is adapted to be releasably connected to the first upper loop and a different one of said bottom loops.

8. The backpack according to claim 1, wherein the lower bag has a plurality of loops around its edge to enable connection to a shoulder strap.

* * * * *